US005834669A

United States Patent [19]

Clift et al.

[11] Patent Number: 5,834,669

[45] **Date of Patent: *Nov. 10, 1998**

[54] METHOD AND APPARATUS FOR OPTICALLY DETERMINING NOTE CHARACTERISTICS FROM HAMMER CATCHERS IN A KEYBOARD OPERATED MUSICAL INSTRUMENT

[75] Inventors: Pamela K. Clift, Vacaville; Charles R. Lee, Placerville, both of Calif.

[73] Assignee: Burgett, Inc., Sacramento, Calif.

[ * ] Notice: The term of this patent shall not extend beyond the expiration date of Pat. No. 5,524,521.

[21] Appl. No.: 661,002

[22] Filed: Jun. 10, 1996

Related U.S. Application Data

[63] Continuation-in-part of Ser. No. 395,459, Feb. 27, 1995, Pat. No. 5,524,521.

[51] Int. Cl.[6] ..... G10G 3/04

[52] U.S. Cl. ..... 84/462; 84/433; 84/DIG. 7

[58] Field of Search ..... 84/461, 462, 433, 84/DIG. 7

[56] References Cited

U.S. PATENT DOCUMENTS

| | | | |
|---|---|---|---|
| 3,511,569 | 5/1970 | Mackta | 356/28 |
| 3,617,627 | 11/1971 | McLean | 178/17 R |
| 3,799,671 | 3/1974 | Schweizer | 356/28 |
| 3,900,262 | 8/1975 | Baxter | 356/28 |
| 4,037,511 | 7/1977 | Del Castillo | 84/478 |
| 4,362,934 | 12/1982 | McLey | 250/229 |
| 4,468,999 | 9/1984 | Bonanno | 84/687 |
| 4,674,069 | 6/1987 | Mizuno | 367/90 |
| 4,686,880 | 8/1987 | Salani et al. | 84/644 |
| 4,736,662 | 4/1988 | Yamamoto | 84/724 |
| 4,790,230 | 12/1988 | Sanderson | 84/462 |
| 4,970,928 | 11/1990 | Tamaki . | |
| 5,012,715 | 5/1991 | Matsunaga et al. | 84/724 |
| 5,164,532 | 11/1992 | Ishii et al. | 84/639 |
| 5,192,820 | 3/1993 | Kawamura et al. | 84/236 |
| 5,194,685 | 3/1993 | Kawamura et al. | 84/670 |
| 5,200,562 | 4/1993 | Kaneko et al. | 84/21 |
| 5,237,125 | 8/1993 | Fields | 84/626 |
| 5,451,708 | 9/1995 | Fujiwara et al. | 84/21 |
| 5,567,902 | 10/1996 | Kimble et al. | 84/658 |

*Primary Examiner*—Michael L. Gellner
*Assistant Examiner*—Shih-yung Hsieh
*Attorney, Agent, or Firm*—John P. O'Banion

[57] ABSTRACT

A method and apparatus for accurately sensing key motion in a keyboard operated musical instrument, in which optical emitters and sensors are positioned above the hammer catchers. The optical emitters and sensors are arranged on a plurality of individually addressable sensor boards, and the sensor boards are divided into a plurality of individually addressable sensor banks. Each sensor board is independently and sequentially activated by a controller according to a specified timing sequence. As the controller activates a sensor board in one bank, allowing the board to warm up, another sensor board in the second bank, which has previously been activated and warmed up, is read and analyzed by the controller. Activation and reading of sensor boards alternates between sensor banks as the sensor boards are sequenced through. This overlapping of sensor board activation and reading, which is made possible by the preferred arrangement of the dual sensor banks as well as the data acquisition method employed, provides for a higher throughput of data conversion than has been heretofore achieved, and thus more efficient sensing and recording of musical expression information from keyboard instruments than has been previously attained.

8 Claims, 7 Drawing Sheets

METHOD AND APPARATUS FOR OPTICALLY DETERMINING NOTE CHARACTERISTICS FROM HAMMER CATCHERS IN A KEYBOARD OPERATED MUSICAL INSTRUMENT

CROSS-REFERENCE TO RELATED APPLICATIONS

This application is a continuation-in-part of application Ser. No. 08/395,459 filed on Feb. 27, 1995, now U.S. Pat. No. 5,524,521, which is incorporated herein by reference.

BACKGROUND OF THE INVENTION

1. Field of the Invention

This invention pertains generally to sensing key motion in keyboard operated musical instruments, and more particularly to a method and apparatus for dynamically sensing hammer catcher motion in a piano and determining velocity and duration characteristics of a played note for electronic recording.

2. Description of the Background Art

Accurate recording of musical expression from a keyboard operated musical instrument such as a piano has long been of interest to musicians, composers, and listeners. Early versions of recording devices punched holes in paper ribbons or rolls for reproduction of musical notes by a "player piano." Advances in electronic and optical technologies have led to the development of more sophisticated and accurate sensing and recording means for keyboard instruments.

The availability of inexpensive and increasingly powerful data processing devices has further propelled development of keyboard recording systems. Sensing and recording systems now exist which are interfaced with microprocessors, with electronically or optically generated key information being digitized and interpreted by software. A standardized communication format for such software has been developed in the music industry under the name Musical Instrument Digital Interface or "MIDI."

Several devices, systems, and methods employing electronic or optical sensors on keyboard instruments are known. Typically, sensors in prior systems are positioned above the keys and point downward, or beneath the keys pointing upward, so as to detect the amount of light reflected back from the keys. Note duration is generally calculated by determining the difference in time from when the key is started to be pressed by the performer and when the key is fully depressed, whereas velocity is determined from the relationship of the distance and time of travel.

A number of deficiencies have become apparent in the aforementioned methods and devices, however. Musical expression information is difficult to sense and record accurately based on the velocity and position of the keys themselves, since key movement may not accurately reflect the musical notes ultimately produced. A particular problem experienced is that musical expression information is especially difficult to sense and record accurately in keyboard instruments in which the keys actuate hammers which strike strings, such as the piano. For example, pianos typically vary in key weight and hammer action from manufacturer to manufacturer. The key distance between the resting position and played position also varies between manufacturers and between different piano designs. A standardized sensing and recording system capable of accurate key expression detection thus cannot be applied to every piano. In order to achieve accurate sensing and recording of key expression, the controlling software for the sensing and recording system must be modified and rewritten for each type of piano, to take into account the variation in the weight, action, and distance traveled by the keys.

Further, certain performance techniques for the piano, such as trills, involve rapid key movement, and generate musical expression which is difficult to measure by key movement. For example, the key movement may be very slight, yet the corresponding hammer action may be substantial, depending upon the individual performer. Thus, accurate musical expression information is difficult or impossible to obtain by sensing key motion.

An additional problem associated with the prior methods and devices is that sensing key motion generally involves sacrificing a portion of the key area to accommodate the sensors. This results in reduced area for performers to work with, and generally detracts from the aesthetics of the piano itself. Further, the difference in reflectivity between the black keys and white keys of a piano must be taken into account and corrected when optical sensing is used. Sensing devices and systems which measure key velocity from the interior of the piano can avoid these problems, but are difficult and time consuming to install, and can require modification of the piano itself.

Yet another drawback of prior methods and devices is that the sensors tend to generate an "on" and "off" type of output from reading key movement, resulting in omission of a great deal of musical expression information.

Regardless of the design or manufacture of a particular piano, however, measurement of the velocity and position of the hammer or hammer catcher results in the same degree of accuracy in sensing musical expression. By monitoring the hammer catchers or hammers, the same sensing apparatus and method can be used on each piano without modification, to obtain a high degree of accuracy in sensing and recording of musical information.

Therefore, there is a need for an apparatus and method for sensing and recording musical expression generated by keyboard instruments which accurately records musical expression generated by keyboard instruments such as the piano, which detects motion of the hammer catchers and does not rely on the detection of key motion, which does not require software modification for different designs and manufactures of piano, which is quick and easy to install, which does not sacrifice keyboard space, and which does not detract from the aesthetic appearance of the piano. The present invention satisfies these needs, as well as others, and generally overcomes the deficiencies found in the background art.

SUMMARY OF THE INVENTION

The present invention pertains generally to a method and apparatus for accurate optical sensing of the motion of the hammer catchers in a piano. The invention is quick and easy to install and use, and can be uniformly applied to pianos of different manufacture and design without requiring modification of the controlling software.

In general terms, the present invention comprises arrays of optical sensors which are positioned adjacent to, and preferably above, the piano hammer catchers. A plurality of sensors are generally arranged on individual sensor boards, with a plurality of sensor boards comprising a sensor bank.

By way of example and not of limitation, the present invention includes eighty-eight optical sensors for detecting motion of each of the eighty-eight hammer catchers in a typical piano. The exact number of sensors would depend on the number of hammer catchers in the particular instrument. Preferably, one to eight optical sensors are mounted on an individual sensor board, with the optical sensors positioned and spaced-apart on the board to corresponding to the spacing between hammer catchers. The sensor boards are preferably arranged into two sensor banks, with each sensor bank comprising six to eight sensor boards. Each of the two sensor banks generally monitors the movement of one half of the eighty-eight hammer catchers.

The sensor boards in each of the two sensor banks are electrically connected together by a common bus, with each of the sensor banks having a separate and independent common bus. Each sensor bank is interfaced with a separate analog to digital or A/D converter which digitizes the analog output of the sensors. The A/D converters are interfaced with controlling data processing means, such as a microprocessor, which directs the activation of each sensor board and acquisition of the sensor data. From this digitized information, the microprocessor generates musical information based on the note velocity and duration sensed from the varying positions of the hammer catcher. The musical information may be in MIDI or other digital format, and is stored on electronic storage media.

In operating the invention, each sensor board is independently and sequentially activated by the microprocessor according to a specified timing sequence. As the microprocessor activates a sensor board in one bank, allowing the board to warm up, another sensor board in the second bank, which has previously been activated and warmed up, is read and analyzed by the microprocessor. This overlapping of sensor board activation and reading, which is made possible by the preferred arrangement of the dual sensor banks as well as the data acquisition method employed, provides for a higher throughput of data conversion than has been heretofore achieved, and thus more efficient sensing and recording of musical expression information from keyboard instruments than has been previously attained. An alternative method is to turn both boards on at the same time, then (after a warm up period) read one board immediately followed by a read of the second board. Both methods are acceptable for quick and accurate hammer position measurements.

An object of the invention is to provide an apparatus and method for sensing and recording musical expression from keyboard instruments which optically senses position and velocity of the hammer catchers of keyboard instruments.

Another object of the invention is to provide an apparatus and method for sensing and recording musical expression from keyboard instruments which is quick and easy to install and use.

Another object of the invention is to provide an apparatus and method for sensing and recording musical expression from keyboard instruments which is mounted internally within the keyboard instrument and does not interfere with the musical performer or the aesthetic appearance of the instrument.

Another object of the invention is to provide an apparatus and method for sensing and recording musical expression from keyboard instruments which can be uniformly applied to all designs and manufactures of pianos without requiring modification of the controlling software.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Referring more particularly to the drawings, for illustrative purposes the present invention is embodied in the method and apparatus for optically sensing and recording key hammer catcher motion of keyboard musical instruments generally shown in FIG. 1 through FIG. 8. It will be appreciated that the invention may vary as to configuration and as to details without departing from the basic concepts as disclosed herein.

Figure 1:
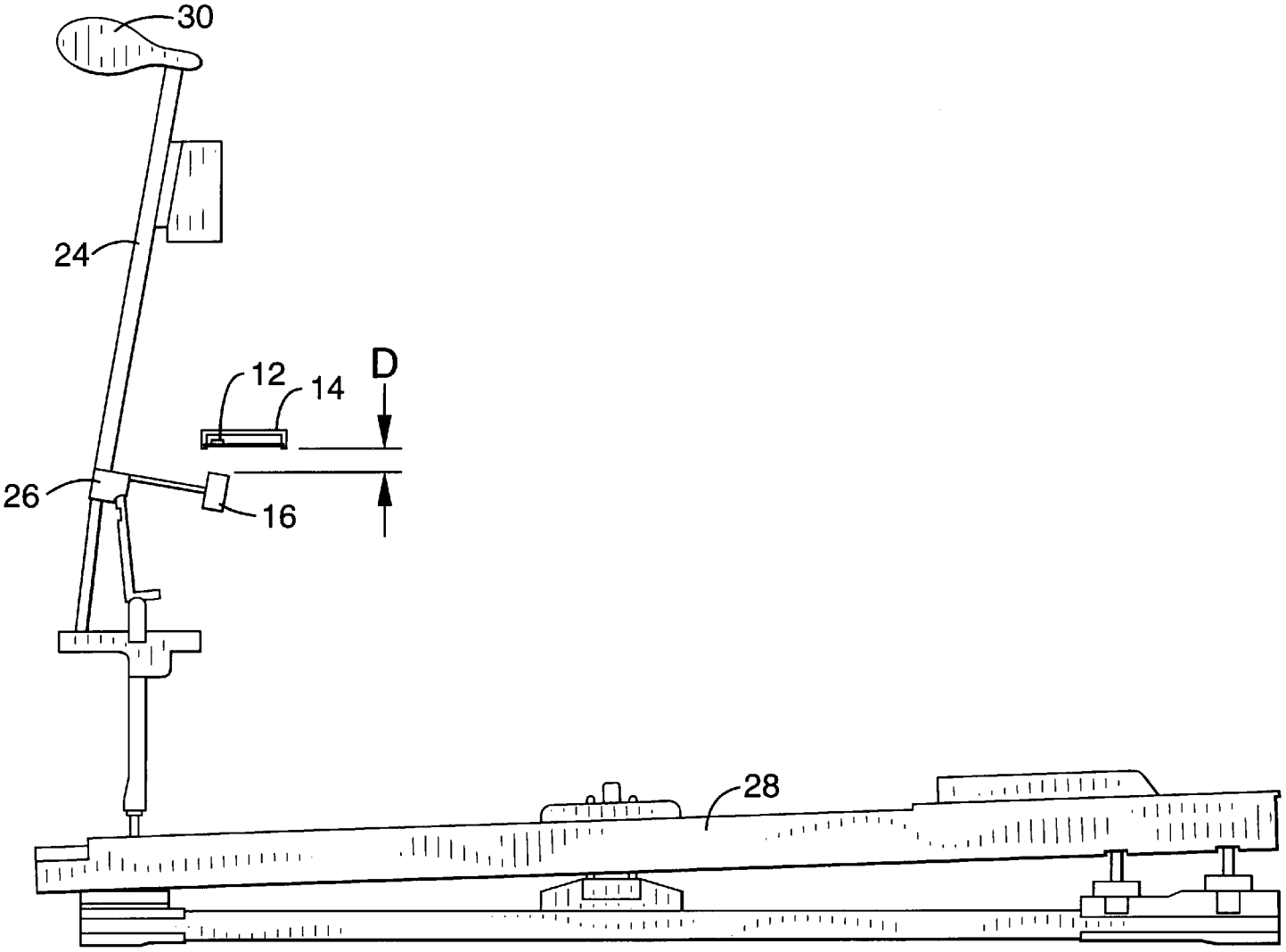
FIG. 1 is a side elevational view of a sensor board and sensor mounted above a hammer catcher in a vertical piano showing the hammer and hammer catcher in the resting position.
Figure 2:
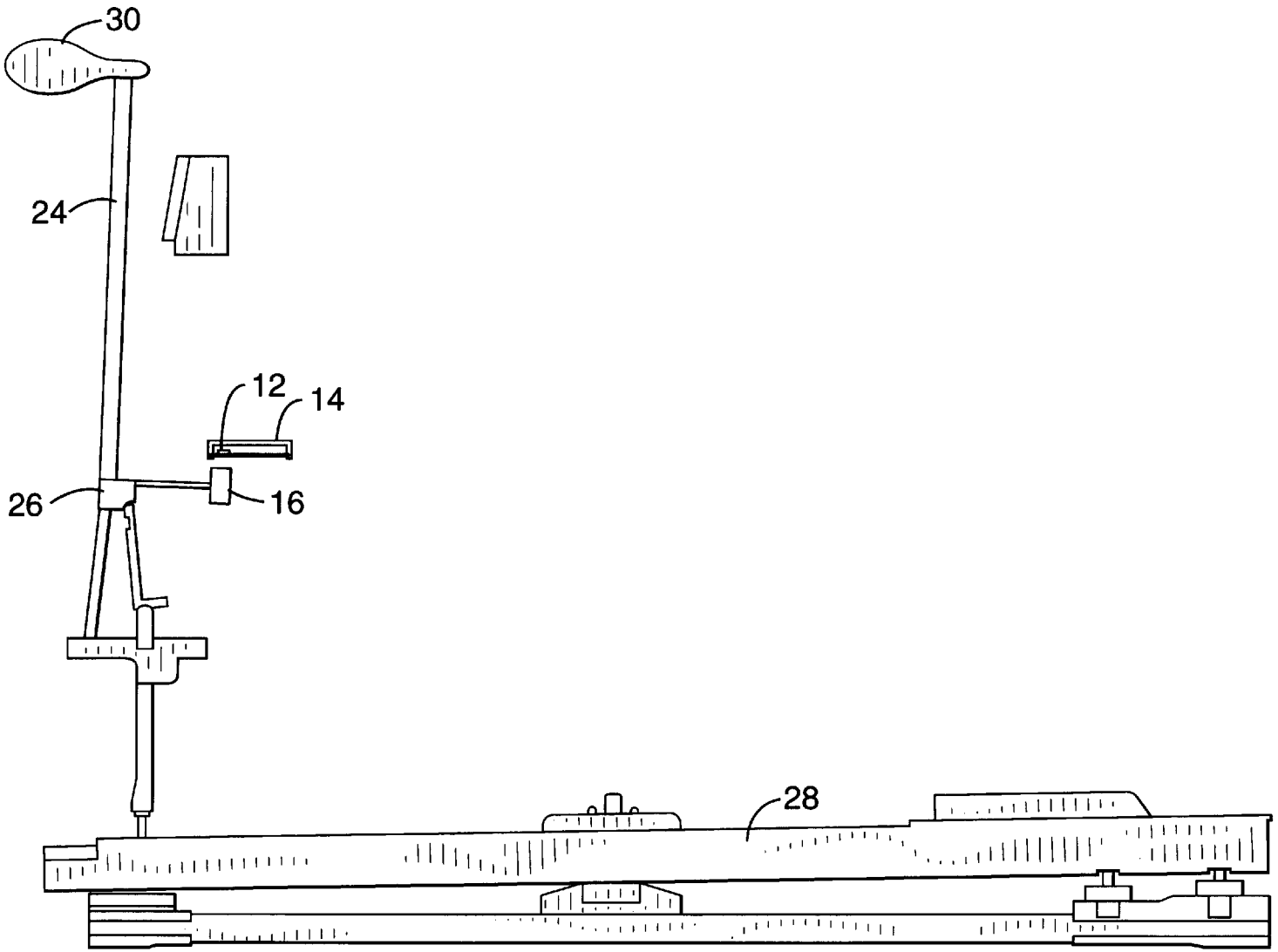
FIG. 2 is a side elevational view of the configuration shown in FIG. 1 showing the hammer and hammer catcher in the strike position.
Figure 3:
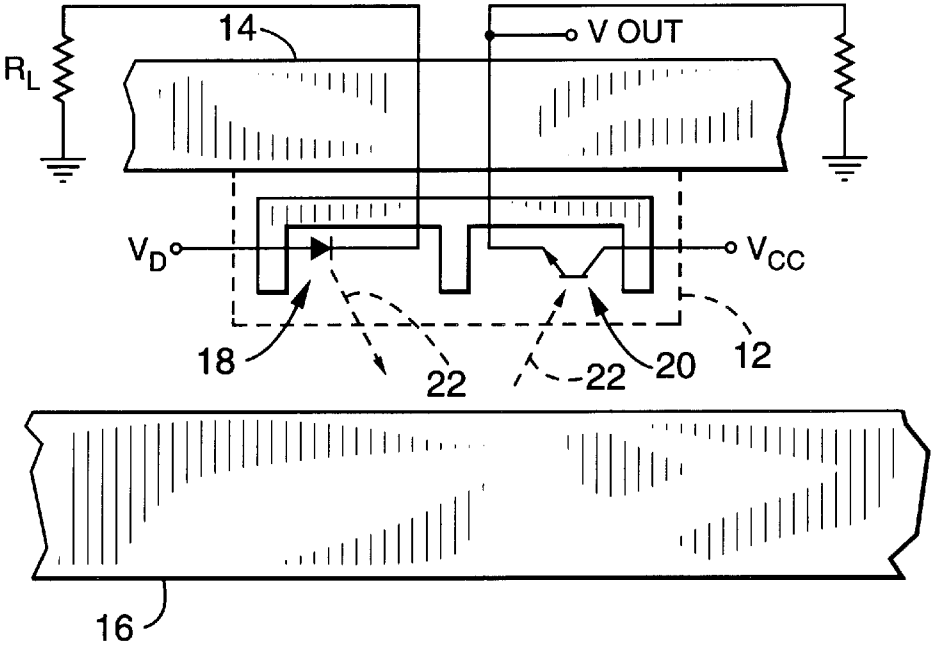
FIG. 3 is a schematic detailed view of the sensor shown in FIG. 1 and FIG. 2.

Referring first to FIG. 1 through FIG. 3, an apparatus for optically sensing hammer catcher motion of a piano or other keyboard musical instrument in accordance with the present invention includes a plurality of optical sensors 12, each of which is mounted on a sensor board 14 which is in turn mounted above hammer catcher 16 as shown. Each optical sensor 12 is generally a single device or package such as a Kodenshi SG107 or the like, which includes two basic components; a light emitting diode or LED 18, which outputs a narrow beam of light, and a photodetector or phototransistor 20. LED 18 is preferably a GaAs or GaAsP type device which emits red light at a wavelength of approximately 980 nanometers. Light 22 is transmitted from LED 18 toward hammer catcher 16 where it is intercepted and reflected back toward photodetector 20.

In a typical vertical piano action, a hammer shank 24 is connected to a butt 26 to which hammer catcher 16 is also connected. As the piano key 28 is actuated, hammer catcher 16 travels between a rest position as shown in FIG. 1 and a strike position as shown in FIG. 2 where hammer 30 strikes the piano string (not shown). Therefore, hammer catcher motion, as well as hammer shank motion, is directly related to key motion and the player's expression.

In the preferred embodiment, sensor boards 14 are mounted at a distance sufficiently above hammer catcher 16 that hammer catcher 16 does not physically contact sensor 12 when in the strike position (FIG. 2), but not exceeding approximately 0.5 inches when in the rest position (FIG. 1). At distances D of 0.5 inches or less, sensors 12 can accurately sense reflected light from unmodified wood of hammer catcher 16 over its entire range of motion, thus allowing the present invention to be employed on any piano without modification. It will be noted that the addition of a reflective tape or the like (not shown) on hammer catcher 16 would permit sensing of hammer catcher motion over a greater distance than 0.5 inches; however it is not necessary to do so for accurate reproduction when sensors 12 are positioned as shown in FIG. 1 and FIG. 2.

Figure 4:
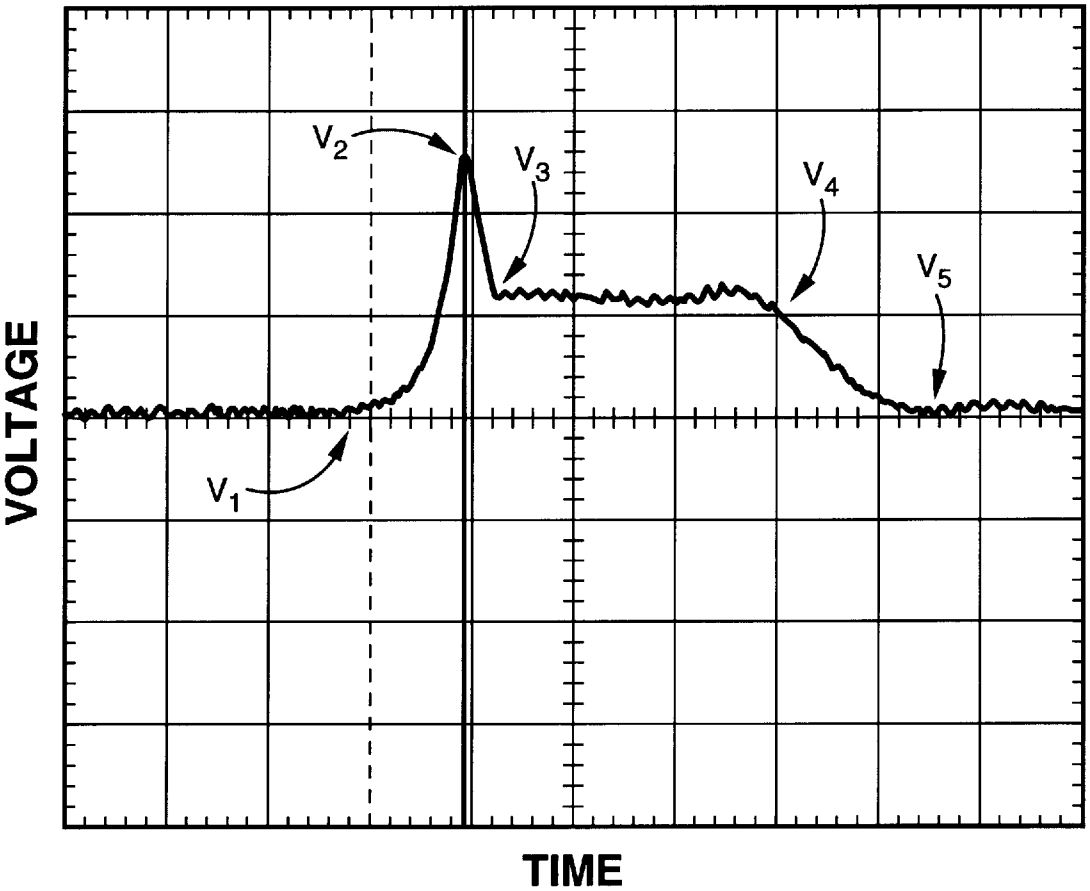
FIG. 4 is a graph showing the relationship of output voltage versus time of the sensor of the present invention as a piano hammer moves from the resting position to the strike position to the kickback position and then again to the rest position.

Referring to FIG. 3 and FIG. 4, LED 18 is activated by application of a driving voltage $V_D$ to one of its input terminals, the other input terminal being connected to ground through a current limiting resistor $R_L$. Photodetectors 20, which are coupled to a source voltage $V_{CC}$, turn on and produce an analog DC output voltage $V_{OUT}$ proportional to the amount of reflected light sensed by photodetector 20. As can be seen in FIG. 4, the variation of sensor voltage output over the entire range of hammer catcher motion is generally depicted as voltage output versus time. At $V_1$, the hammer catcher 16 is in its resting position, as shown in FIG. 1. In this position, hammer catcher 16 is at its furthest distance from sensor 12, and thus photodetector 20 produces the lowest voltage output. As a player depresses a key and actuates hammer 30, hammer catcher 16 begins to accelerate and the distance between hammer catcher 16 and sensor 12 decreases, with a corresponding increase in voltage output as more reflected photons reach photodetector 20. At $V_2$, where hammer 30 strikes the string and hammer catcher 16 is at its closest approach to sensor 12, the voltage output of photodetector 20 is at its maximum. After a string has been struck by hammer 30, hammer catcher 16 begins to fall to the kickback position, indicated by $V_3$. Hammer catcher 16 remains in this position as long as the player keeps the key depressed. Upon releasing the key, shown at voltage output $V_4$, hammer catcher 16 beings to fall back to the resting position depicted in FIG. 1, resulting in the voltage output $V_5$ returning to the same level as $V_1$.

Since the distance between sensor 12 and hammer catcher 16 is known, the velocity of hammer catcher 16 can be determined from that distance and the time elapsing between voltage outputs $V_1$ and $V_2$. This velocity factor corresponds to the strength of the hammer strike and the volume of the tone produced, and thus contains important musical expression information. Similarly, the duration of the hammer strike and thus the musical tone can be determined by the time elapsed between $V_2$ (note on), which corresponds to the actual striking of the string, and $V_5$ (note off), at which point hammer catcher 16 returns to its resting position and string vibration is damped. In situations where a player depresses a key with insufficient force to cause the hammer to reach the string, the output voltage level obtained from sensing hammer catcher motion will not reach the level of $V_2$, indicating that no musical tone is produced.

Figure 5:
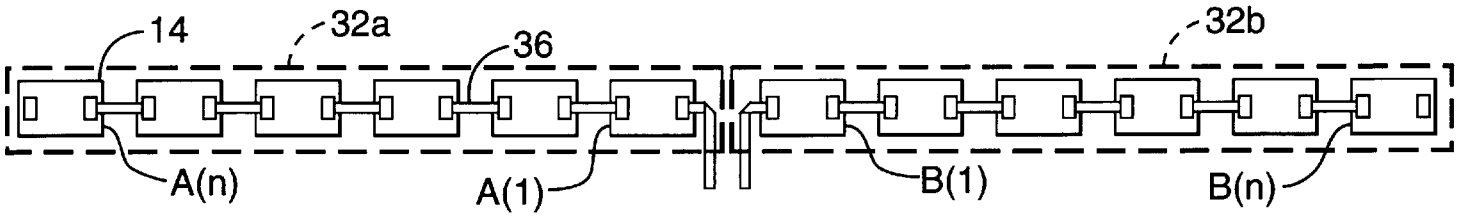
FIG. 5 is a diagrammatic view showing a typical sensor bank arrangement in accordance with the present invention.

It will be appreciated that a typical full size piano keyboard typically has eighty-eight keys 28 and eight-eight corresponding hammer catchers 16. Thus, in a full size keyboard musical instrument, the present invention thus generally employs eighty-eight sensors 12. Referring to FIG. 5, each sensor board 14 contains from one to eight sensors 12, and the sensor boards 14 are arranged into a pair of sensor banks 32*a*, 32*b*. Each sensor bank 32*a*, 32*b* contains six to eight sensor boards 14 and senses the motion of one-half of the eighty-eight hammer catchers. Thus, for the typical keyboard musical instrument requiring eighty-eight sensors 12, a variety of combinations of sensors 12 per sensor board 14 and sensor boards 14 per sensor banks 32*a*, 32*b* are possible. Sensor boards 14 are positioned above hammer catchers 16 so that sensors 12 are above the approximate lateral midpoint of the hammer catcher. The sensor boards can be attached to a support rail or the like (not shown) which is mounted above the action in the piano. Since the sensor boards are mounted above the hammer catchers instead of the piano keys, the invention will not interfere with the musician and, further, there is no need to distinguish between black and white keys.

Figure 6:
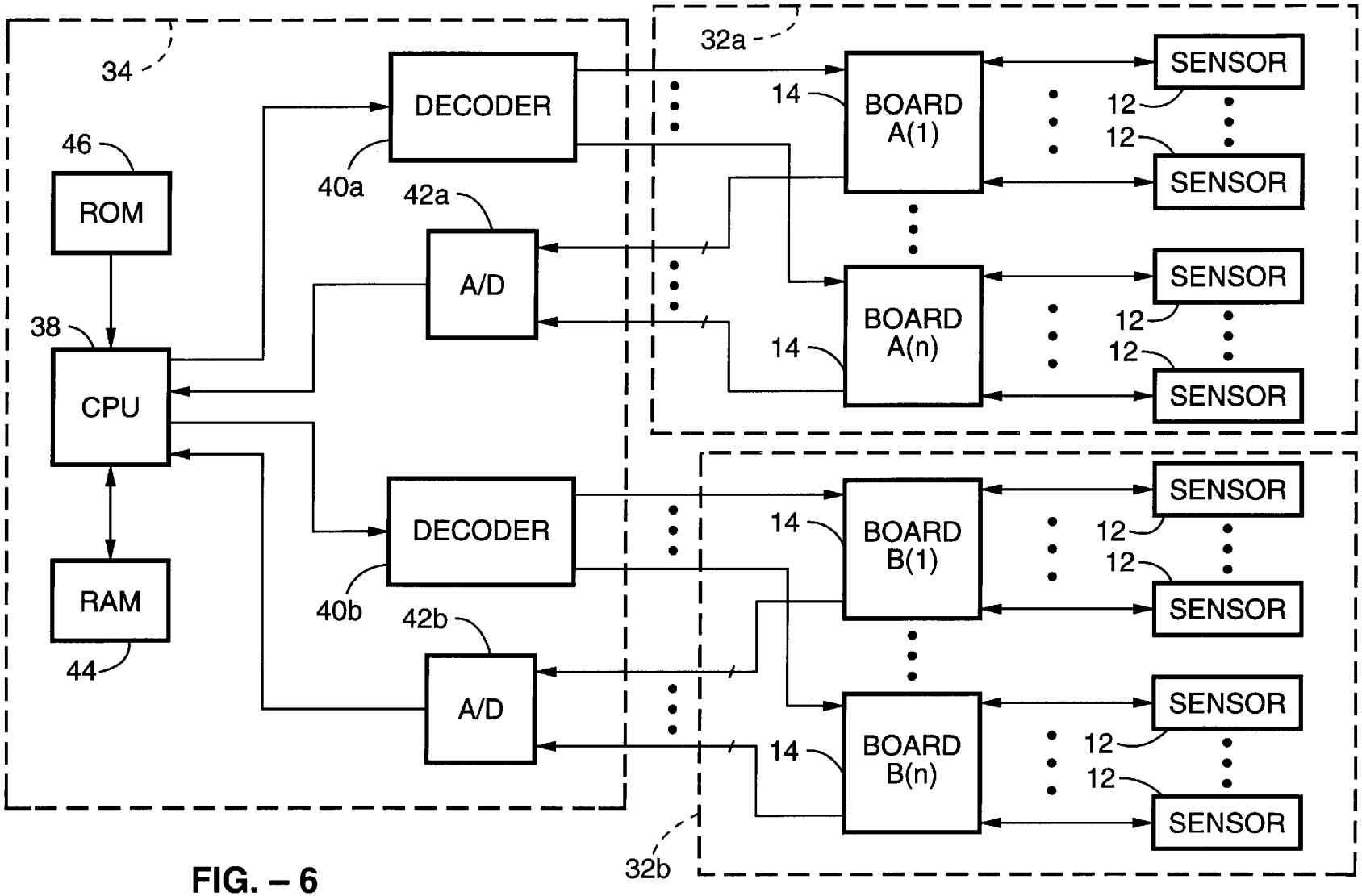
FIG. 6 is a functional block diagram showing the controller processor and sensor configuration of the present invention.

Each sensor board 14 in a sensor bank is individually addressable so that a particular sensor board can be selected by controller 34. Sensor boards 14 are daisy-chained by an interconnecting cable 36, which is ultimately connected to controller 34. Referring also to FIG. 6, controller 34 includes a CPU 38, which is an 8051-type microcontroller or the like. A sensor board 14 in bank 32*a* is addressed by CPU 38 through decoder 40*a* which is a 74HC238 or the like. The voltage outputs of each sensor 12 contained on the sensor board 14 which is so addressed are simultaneously read by a multiplexing A/D convertor 42*a* which is a MAX155 or the like. Similarly, sensor boards in bank 32*b* are addressed through decoder 40*b* and the outputs of the sensors read by A/D convertor 42*b*. Once the sensor voltage outputs are read, the information is stored in RAM 44 and processed by CPU 38. RAM 42 also contains working variables and control programs. CPU 38 monitors the sensor outputs to identify when there have been changes in voltage outputs and the time between those changes. The resulting data is then compared to values in one or more "look-up" tables contained in ROM 46, and is translated to strike velocity (e.g., from the time between $V_1$ and $V_2$ in FIG. 4 and the maximum distance of travel), key position, note duration (e.g., the time between $V_2$ and $V_5$ in FIG. 4) and the like. By making ROM 46 of a flash-type, the "look-up" tables can be updated or modified as desired.

Note that, unlike conventional optical systems, the sensor readings do not simply provide an "on" or "off" state of the hammer. Instead, the sensors provide the full position of the hammer at any given moment. The analog voltage output for the entire range of hammer catcher motion shown in FIG. 4 is digitized and processed by controller 34 to produce musical expression information at a level of accuracy which generally cannot be achieved by conventional systems. The resolution of the musical expression information contained in the hammer catcher movement is limited only by the capabilities of A/D converters, which is typically 256 positions for an 8 bit A/D converter.

As noted above, when a sensor board is addressed each sensor 12 on that board is simultaneously activated and read by controller 34. The current requirement for this number of sensors operating simultaneously is rather large and, to make the current requirement more practical, it is preferable to pulse the sensors to their on state just before they are read and then turn them off again immediately thereafter. Several sensors may be pulsed on and off together, as long as the total number of sensors on at one time does not exceed the available current. Also, sensors 12 generally require a brief "warm up" time between the time they are pulsed on and the time which their voltage outputs can be read.

Figure 7:
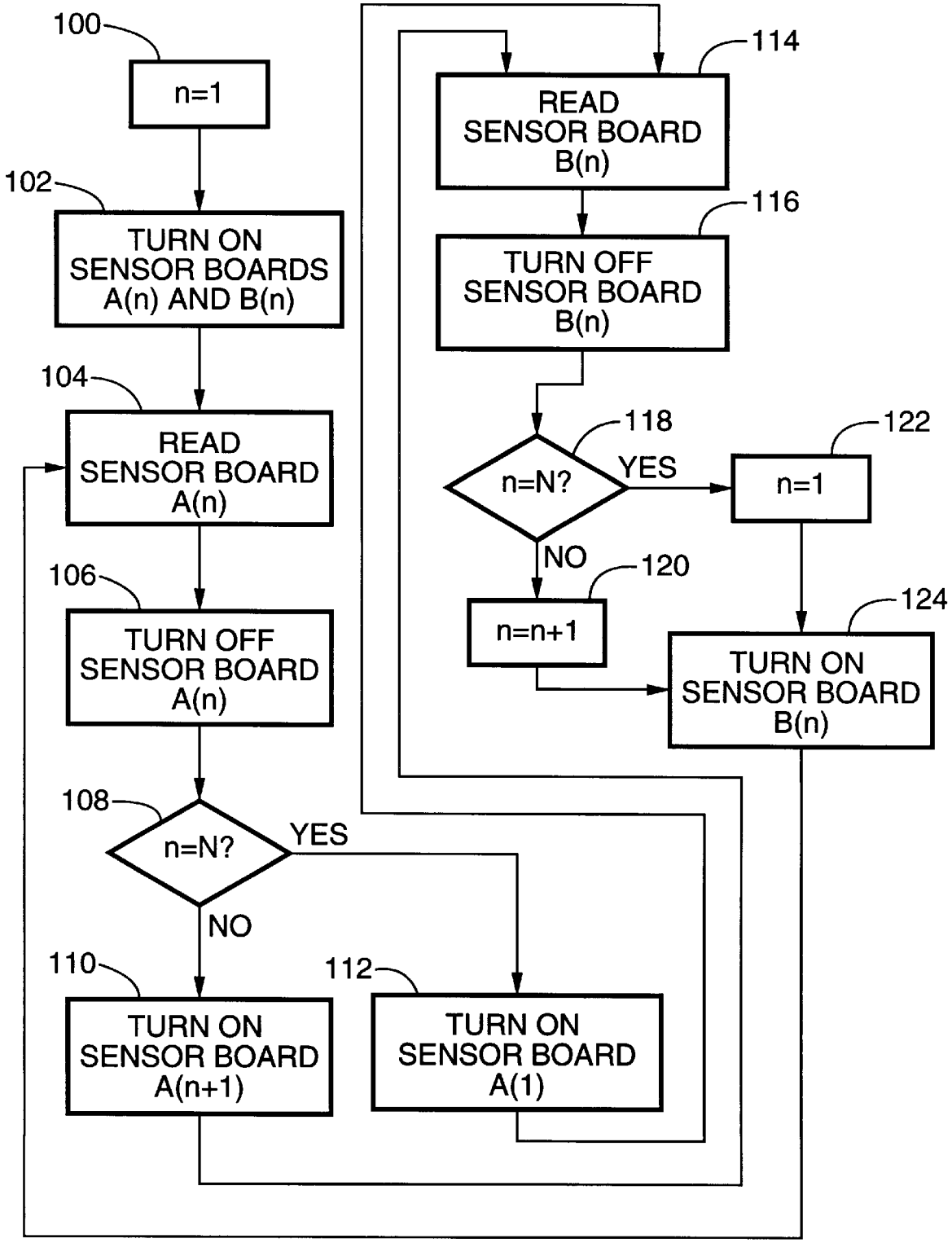
FIG. 7 is a flow chart showing the sensor activation and data acquisition method of the present invention.

Referring also to FIG. 7, controller 34 alternates between sensor banks 32*a*, 32*b* and sequentially activates and reads sensor boards 14 as follows. Designating sensor bank 32*a* as sensor bank A and sensor bank 32*b* as sensor bank B, and assuming that each sensor bank includes a total of N sensor boards, at step 100 the counter n is set to n=1. Next, at step 102, sensor boards A(n) and B(n) are turned on so that they can warm up. Then at step 104, the outputs of the sensors on sensor board A(n) are read. At step 106, sensor board A(n) is turned off. At step 108, the value of counter n is tested against N to determine if all of the sensor boards in sensor bank A have been scanned. If not, at step 110, sensor board A(n+1) is turned on so that it can warm up. Otherwise, sensor board A(1) is turned on at step 112. Next, at step 114, the outputs of the sensors on sensor board B(n) are read. At step 116, sensor board B(n) is turned off. At step 118, the value of counter n is tested against N to determine if all of the sensor boards in sensor bank B have been scanned. If not, at step 120 the value of counter n is incremented to n+1. Otherwise, at step 122 n is reset to n=1. At step 124, sensor board B(n) is then turned on so that it can warm up. This process then continues at step 104.

As can be seen, the data acquisition method of the present invention is designed to have controller 34 select a sensor board to warm up in a first bank, while a sensor board in a second bank, having been previously turned on, can be read and analyzed. After being read, that sensor board in the second bank is turned off, and the next board on the same sensor bank is turned on to warm up. Controller 34 can then read the sensor board in the first bank that was previously turned on. The resultant "overlapping" of sensor boards allows for a high throughput of data. Basically, while one board is being read, another is being warmed up to that it can be immediately read when the first is completed.

Referring again to FIG. 5, in the data acquisition method described above the sensor boards designated as A(1) and B(1) are the preferably the boards in the center of keyboard 28 and closest to controller 34, whereas the sensor boards designated as A(N) and B(N) are the boards at the ends of the chain. Using a scan rate of approximately 25 MHz, the entire keyboard can be scanned in approximately 0.5 $\mu$s. Further, if all of the hammer positions are sampled in 1 ms or less, the speed of data acquisition will exceed the maximum possible hammer velocity, so as to provide for an accurate representation of the music being performed. Since A/D convertors 42*a*, 42*b* multiplex the outputs of all of the sensors on a particular sensor board at the same time, data acquisition is further increases.

Accordingly, at selected time intervals a group of sensors are scanned and a mode value is stored which relates to the voltage level sensed. For example, mode 0 would correspond to the rest position ($V_1$), mode 1 would correspond to the key moving down, mode 3 would correspond to the strike position ($V_2$), mode 4 would correspond to the key being held down ($V_3$), mode 5 would correspond to the key returning to its rest position ($V_4$) and mode 6 (or mode 1 again) would correspond to the key in the rest position ($V_5$). Once a hammer starts moving, a count will be accumulated from which velocity can be determined. When the mode is reached indicating a strike has occurred, MIDI or equivalent data will be recorded for that key. Additionally, when the hammer returns to rest, MIDI or equivalent data will be recorded.

Figure 8:
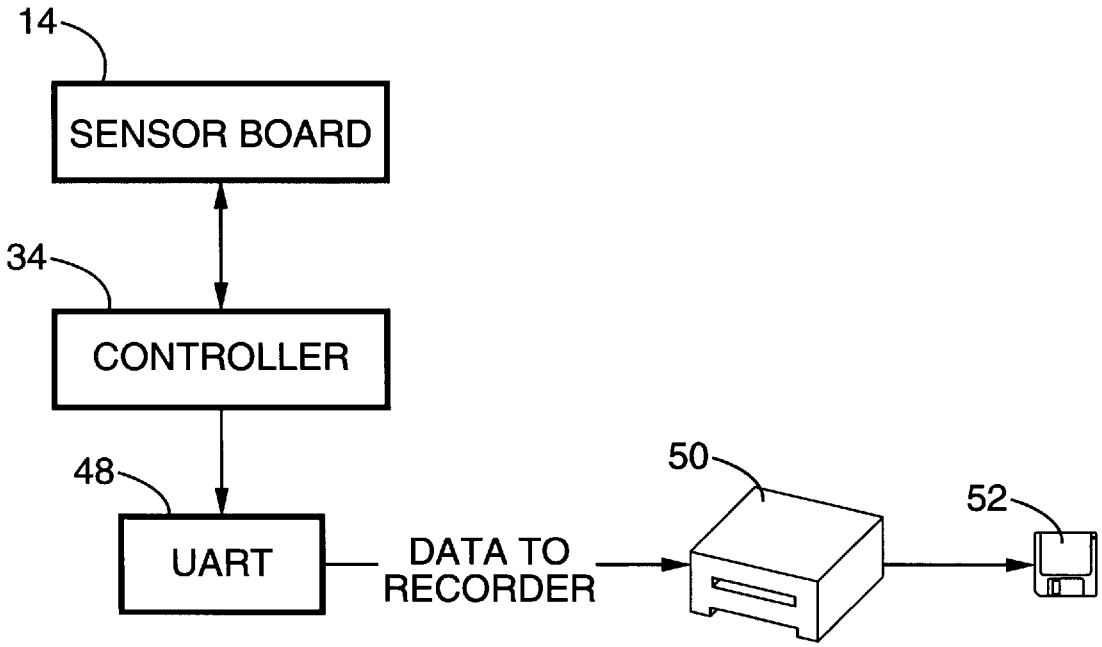
FIG. 8 is a functional block diagram of a musical performance recording apparatus in accordance with the present invention.

Referring to FIG. 8, a conventional UART 48 serves as a communications interface for controller 34 to send data to a recorder 50 for storage on a disk 52. It should be noted, however, that the output data can be presented in any convenient format and that other communications, recording, or storage devices could be used.

While measurement of key movements using conventional devices can produce key velocity and duration results, such measurement presents an inaccurate picture of the actual piano performance. Further, pianos differ in key weights and travel and, therefore, conventional devices must be customized for each piano. The present invention, however, provides for accurately determining piano performance by testing hammer positions as they go through their full motion cycle. By continuously testing the position of the hammer at all times, the complete keyboard performance can be analyzed. Further, the present invention can be fitted to any piano without modification. Also, those skilled in the art will appreciate that the method and apparatus of the present invention could be used to dynamically sense proportional movement of the three foot pedals commonly found on a piano.

Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. An apparatus for determining key motion characteristics in an upright acoustic piano from hammer catcher motion, comprising:

(a) a plurality of sensor banks, each said sensor bank including a plurality of sensor boards, each said sensor board including a plurality of light emitters and corresponding light sensors, each said light sensor producing an output voltage responsive to intensity of sensed light, each said light emitter and corresponding light sensor positioned adjacent to a corresponding hammer catcher in an upright acoustic piano, wherein each said light sensor produces an output voltage which correlates with a position of said hammer catcher over an entire range of motion of said corresponding hammer catcher; and (b) control means for addressing said sensor banks, addressing said sensor boards, activating said light emitters and said light sensors in said addressed sensor boards, acquiring voltage output data from said light sensors in said addressed sensor boards, sequencing between addressing a sensor bank and a sensor board in said addressed sensor bank, and determining key motion characteristics from said acquired output voltage data.

2. An apparatus as recited in claim 1, further comprising means for recording said key motion characteristics on a machine readable storage media.

3. An apparatus for determining key motion characteristics in an upright acoustic piano from hammer catcher motion, comprising:

(a) first and second sensor banks, each said sensor bank including a plurality of sensor boards, each said sensor board including a plurality of light emitters and corresponding light sensors, each said light sensor producing an output voltage responsive to intensity of sensed light, said output voltage correlating with a position of a corresponding hammer catcher over an entire range of motion of said corresponding hammer catcher, each said light emitter and corresponding light sensor positioned adjacent to a hammer catcher in an upright acoustic piano; and (b) control means for addressing said first and second sensor banks, sequentially addressing said sensor boards in said sensor banks, activating said light emitters and said light sensors in said addressed sensor boards, acquiring voltage output data from said light sensors in said addressed sensor boards, alternating between addressing a sensor board in said first sensor bank and a sensor board in said second sensor bank, and determining key motion characteristics from said acquired output voltage data.

4. An apparatus as recited in claim 3, further comprising means for recording said key motion characteristics on a machine readable storage media.

5. A method for determining key motion characteristics in an upright acoustic piano from hammer catcher motion, comprising the steps of:

(a) positioning a plurality of sensor boards adjacent to hammer catchers in an upright acoustic piano, said sensor boards divided into a plurality of sensor banks, each said sensor board including a plurality of light emitting diodes, each said light emitting diode positioned adjacent to a corresponding hammer catcher, each said sensor board including a plurality of photosensors, each said photosensor positioned adjacent to a corresponding light emitting diode and adjacent to said corresponding hammer catcher;

(b) sequentially addressing said sensor banks;

(c) sequentially addressing said sensor boards;

(d) activating said light emitters and said light sensors in said addressed sensor boards, wherein said light sensors each produce an output voltage correlating with a position of a corresponding hammer catcher over an entire range of motion of said corresponding hammer catcher;

(e) acquiring voltage output data from said light sensors in said addressed sensor boards;

(f) sequencing between addressing a sensor bank and a sensor board in said addressed sensor bank; and (g) determining key motion characteristics from said acquired output voltage data.

6. A method as recited in claim 5, further comprising the steps of recording said key motion characteristics on a machine readable storage media.

7. A method for determining key motion characteristics in an upright acoustic piano from hammer catcher motion, comprising the steps of:

(a) positioning a plurality of sensor boards adjacent to hammer catchers in an upright acoustic piano, said sensor boards divided into first and second sensor banks, each said sensor board including a plurality of light emitting diodes, each said light emitting diode positioned adjacent to a corresponding hammer catcher, each said sensor board including a plurality of photosensors, each said photosensor positioned adjacent to a corresponding light emitting diode and adjacent to said corresponding hammer catcher;

(b) sequentially addressing said sensor banks;

(c) sequentially addressing said sensor boards;

(d) activating said light emitters and said light sensors in said addressed sensor boards, wherein said light sensors each produce an output voltage correlating with a position of a corresponding hammer catcher over an entire range of motion of said corresponding hammer catcher;

(e) acquiring voltage output data from said light sensors in said addressed sensor boards;

(f) alternating between addressing a sensor board in said first sensor bank and a sensor board in said second sensor banks; and (g) determining key motion characteristics from said acquired output voltage data.

8. A method as recited in claim 7, further comprising the steps of recording said key motion characteristics on a machine readable storage media.

* * * * *